US006601881B2

(12) United States Patent
Mandell et al.

(10) Patent No.: US 6,601,881 B2
(45) Date of Patent: Aug. 5, 2003

(54) PUSH-ACTION DOOR RELEASE DEVICE AND METHOD OF INSTALLING THE SAME

(76) Inventors: Julian Mandell, 1 Fonthill Park, Bloomfield, CT (US) 06002; Morton A. Silverman, 311 High Tower Rd., Southington, CT (US) 06489

( * ) Notice: Subject to any disclaimer, the term of this patent is extended or adjusted under 35 U.S.C. 154(b) by 0 days.

(21) Appl. No.: 09/969,945

(22) Filed: Oct. 3, 2001

(65) Prior Publication Data

US 2002/0153730 A1 Oct. 24, 2002

Related U.S. Application Data

(60) Provisional application No. 60/286,195, filed on Apr. 24, 2001.

(51) Int. Cl.[7] ..... E05B 65/10

(52) U.S. Cl. ..... 292/92; 292/2; 292/93; 292/345; 292/DIG. 21; 292/DIG. 65; 70/92

(58) Field of Search ..... 292/92, 93, DIG. 65, 292/349, 2, 21; 70/92

(56) References Cited

U.S. PATENT DOCUMENTS

| | | | | | |
|---|---|---|---|---|---|
| 805,411 | A | * | 11/1905 | Clark | 292/21 |
| 808,673 | A | * | 1/1906 | Morewood | 292/21 |
| 824,173 | A | * | 6/1906 | Clark | 292/21 |
| 917,685 | A | | 4/1909 | Voight | |
| 943,973 | A | | 12/1909 | Hope et al. | |
| 975,456 | A | * | 11/1910 | Prevost | 292/93 |
| 982,388 | A | | 1/1911 | Pincus | |
| 990,358 | A | * | 4/1911 | Hodgkinson | 292/92 |
| 1,056,937 | A | | 3/1913 | Pratt | |
| 1,105,252 | A | | 7/1914 | Carstens | |
| 1,168,792 | A | * | 1/1916 | Dyer | 292/21 |
| 1,441,336 | A | * | 1/1923 | Flowers | 70/92 |
| 1,898,505 | A | * | 2/1933 | Soemer | 292/92 |
| 2,087,165 | A | * | 7/1937 | Ruth | 292/92 |
| 2,180,670 | A | * | 11/1939 | Erickson | 292/92 |
| 2,732,237 | A | * | 1/1956 | Kihn et al. | 292/67 |
| 2,945,372 | A | * | 7/1960 | Reed | 70/92 |
| 2,992,846 | A | * | 7/1961 | Schwanz et al. | 292/127 |
| 3,024,053 | A | * | 3/1962 | Cox et al. | 292/93 |
| 3,025,095 | A | * | 3/1962 | Christensen | 292/336.3 |
| 3,073,142 | A | * | 1/1963 | Stebbins | 70/92 |
| 3,076,328 | A | * | 2/1963 | Rhodes et al. | 70/92 |
| 3,788,688 | A | * | 1/1974 | Chandler | 292/92 |
| 3,877,262 | A | | 4/1975 | Williams | 70/92 |
| 4,065,160 | A | * | 12/1977 | Gilmore, Jr. | 292/92 |
| 4,101,153 | A | | 7/1978 | Dozier | 292/92 |
| 4,167,280 | A | | 9/1979 | Godec et al. | 292/92 |
| 4,181,335 | A | * | 1/1980 | Thoren | 292/92 |
| 4,185,859 | A | * | 1/1980 | Cunningham | 292/93 |
| 4,225,163 | A | * | 9/1980 | Hubbard et al. | 292/21 |
| 4,429,909 | A | * | 2/1984 | Lindquist | 292/92 |

(List continued on next page.)

*Primary Examiner*—William L. Miller
*Assistant Examiner*—Carlos Lugo
(74) *Attorney, Agent, or Firm*—Libert & Associates; Victor E. Libert

(57) ABSTRACT

A door release device (10) includes a pivot bar (40) on which a push plate (44) and an actuator (48) are mounted. The actuator (48) is aligned with a door latch handle (20) and the fixed end of pivot bar (40) is pivotable about a pivot pin (42) carried in its associated mounting bracket (28*b*). The active end of the pivot bar (40) is freed to move within its associated mounting bracket (28*a*) by removal of the pivot pin (42) associated with bracket (28*a*). The door release device (10) is used by pushing on push plate (44) or pivot bar (40) to advance actuator (48) against door latch handle (20) to open the door. A method for securing door release device (10) to a door (12) includes securing the mounting brackets (28*a*, 28*b*) to door (12) with one end of pivot bar (40) positioned to align actuator (48) with door latch handle (20), and removing the pivot pin (42) from the mounting bracket adjacent to door latch handle (20).

15 Claims, 4 Drawing Sheets

U.S. PATENT DOCUMENTS

| | | | | | |
|---|---|---|---|---|---|
| 4,498,319 | A | | 2/1985 | Balducci et al. | 70/92 |
| 5,054,825 | A | | 10/1991 | Mangin et al. | 292/92 |
| 5,139,292 | A | * | 8/1992 | Beals | 292/92 |
| 5,169,185 | A | | 12/1992 | Slaybaugh et al. | 292/92 |
| 5,253,905 | A | * | 10/1993 | Hutson | 292/92 |
| D347,565 | S | | 6/1994 | Cziko | D8/302 |
| 5,340,171 | A | | 8/1994 | Slaybuagh et al. | 292/21 |
| 5,490,696 | A | * | 2/1996 | Hutson | 292/92 |
| 5,496,081 | A | * | 3/1996 | Rice | 292/259 R |
| 6,102,451 | A | * | 8/2000 | Merryman | 292/92 |
| 6,145,897 | A | * | 11/2000 | Locher | 292/92 |

* cited by examiner

A
B
10
14a
14b
16
20
24
28a
28b
30
30c
34
38
40
42a
42b
44
48

PUSH-ACTION DOOR RELEASE DEVICE AND METHOD OF INSTALLING THE SAME

CROSS-REFERENCE TO RELATED APPLICATION

This application claims the benefit of provisional patent application Ser. No. 60/286,195 of Julian Mandell and Morton A. Silverman, filed on Apr. 24, 2001 and entitled "Push-Action Door Release Device".

BACKGROUND OF THE INVENTION

1. Field of the Invention

The present invention is concerned with a push-action door release device and, in particular, with a push-action door release device which is well suited for installation on an existing door, such as a storm door or screen door, having a lever-type handle.

2. Related Art

Doors which have latches that are operated by a push-bar mechanism are, of course, well known in the art. Such push-bar mechanisms employ a linkage which extends into the core of the door and is operatively connected to the latch mechanism to withdraw the bolt or striker from the striker plate contained in the doorjamb. Push-bar opening devices are usually found on the interior side of doors in public places such as theaters, museums, etc., because they permit rapid opening of the door by simply pushing against a bar which opens the latch, thereby enabling a continuation of the pushing action to open the door. The push bars may be mounted for downwardly pivoting travel, with the bar remaining parallel to the interior side of the door, or for horizontal travel. Either arrangement enables opening the door by pushing the bar with the hands or by simply leaning or pushing against the bar with the arm, torso, etc. This facilitates opening the door in an emergency situation, as the door can be opened simply by the press of people against it, and also facilitates opening the door when a person's hands are disabled or occupied, e.g., by carrying parcels.

SUMMARY OF THE INVENTION

The present invention is concerned with a pivotable push-action door release device which, in response to pressure imposed on it, will actuate a lever-type handle of a door, and which does not require the installation of a linkage into the core of the door, thereby facilitating and simplifying addition of the device to existing doors, especially by homeowners.

More specifically, the present invention is concerned with a push-action door release device which is of simple and relatively inexpensive construction, and to a method by which it may readily be mounted to the interior of any door having a lever-type handle. Once installed, the door release device of the present invention enables operation of the door handle to withdraw the striker (bolt) of the door from the striker plate in the door jamb by simply pushing on the door release device with the hand, elbow, arm, torso, etc. In this way, the door may readily be opened in a hands-free mode, that is, the handle may be operated to open the door without the use of a person's hands to manipulate the handle.

In accordance with the present invention, there is provided a push-action door release device which comprises a pivot bar having first and second opposite ends. The first end of the pivot bar is pivotably connectable to a first mounting bracket by a first removable pivot pin, and the second end of the pivot bar is pivotably connectable to a second mounting bracket by a second removable pivot pin. The mounting brackets are dimensioned and configured to be secured to a door having a latch handle to position the pivot bar substantially parallel to the door with one end of the pivot bar disposed adjacent to the latch handle and unpinned from its associated mounting bracket to constitute that end as the active end of the pivot bar. The other end of the pivot bar is connected by its associated pivot pin to its associated mounting bracket to constitute that end as the fixed end of the pivot bar. The mounting brackets are further configured to define an operational travel path of the active end of the pivot bar within its associated mounting bracket between a neutral position and a handle release position. The release device as a whole is dimensioned and configured to engage and operate the latch handle of such door when the active end of the pivot bar is caused to travel along its operational travel path to its handle release position by pivoting the fixed end of the pivot bar about its associated pivot pin.

Other aspects of the invention provide one or more of the following features, alone or in combination. The pivot bar may have an actuator extending transversely therefrom, the actuator being dimensioned and configured to engage and operate the latch handle upon arrival of the active end of the pivot bar at its handle release position; a push plate may be attached to the pivot bar and extend transversely thereof; at least the actuator may be selectively mountable adjacent to either end of the pivot bar; and both the actuator and the push plate may be selectively mountable in at least two different positions axially along the pivot bar.

In accordance with another aspect of the present invention, the pivot bar may have at least two sets of mounting formations for each of the push plate and actuator, the two sets of mounting formations being located on opposite transverse sides of the pivot bar. One set of mounting formations is axially positioned along the pivot bar whereby to locate the push plate and actuator to accommodate a right-hand-opening door, and the other set of mounting formations is axially positioned along the pivot bar whereby to locate the push plate and actuator to accommodate a left-hand-opening door.

A related aspect of the present invention provides that the mounting formations are holes dimensioned and configured to receive removable fasteners to removably secure the push plate and actuator to the pivot bar.

In accordance with a method aspect of the present invention, there is provided a method for securing to a door equipped with a latch handle a door release device comprised of a pivot bar having first and second opposite ends, with the first end of the pivot bar connected to a first mounting bracket by a first removable pivot pin, and the second end of the pivot bar connected to a second mounting bracket by a second removable pivot pin. The method comprises the following steps: (a) securing the device to a door having a latch handle to position the pivot bar substantially parallel to the door with one end of the pivot bar disposed adjacent to the latch handle to constitute that end as the active end of the pivot bar, and the other end as the fixed end of the pivot bar; and (b) removing the pivot pin from the mounting bracket at the active end of the pivot bar. This serves to free the active end to travel along an operational travel path within its associated mounting bracket between a neutral position and a latch handle release position, when the pivot bar is pivoted about its fixed end.

Another method aspect of the invention provides that the pivot bar further comprises at least two sets of actuator mounting formations, e.g., holes to receive fasteners such as screws, the respective sets of mounting formations being located adjacent respective opposite ends of the pivot bar, the method further comprising mounting the actuator on the set of actuator mounting formations adjacent the active end of the pivot bar.

In another method aspect, at least two of the respective sets of actuator mounting formations are located on diametrically opposite sides of the pivot bar and the method further comprises positioning the pivot bar relative to such door so that the set of mounting formations on which the actuator is to be mounted faces outwardly away from the door.

Other aspects of the present invention will become apparent from the following description.

BRIEF DESCRIPTION OF THE DRAWINGS

FIG. 2 is a plan view of the door release device of FIG. 1, with parts broken away, showing the door release device in solid and dash lines in its rest position and in phantom lines in its door-opening position;

FIG. 2A-1 is a side elevation view taken along line A—A of FIG. 2 showing the door release device in its rest position;

FIG. 2A-2 is a view corresponding to that of FIG. 2A-1 showing the door release device in its door-opening position;

FIG. 2B is a side elevation view taken along line B—B of FIG. 2;

DETAILED DESCRIPTION OF THE INVENTION AND SPECIFIC EMBODIMENTS THEREOF

Figure 1:
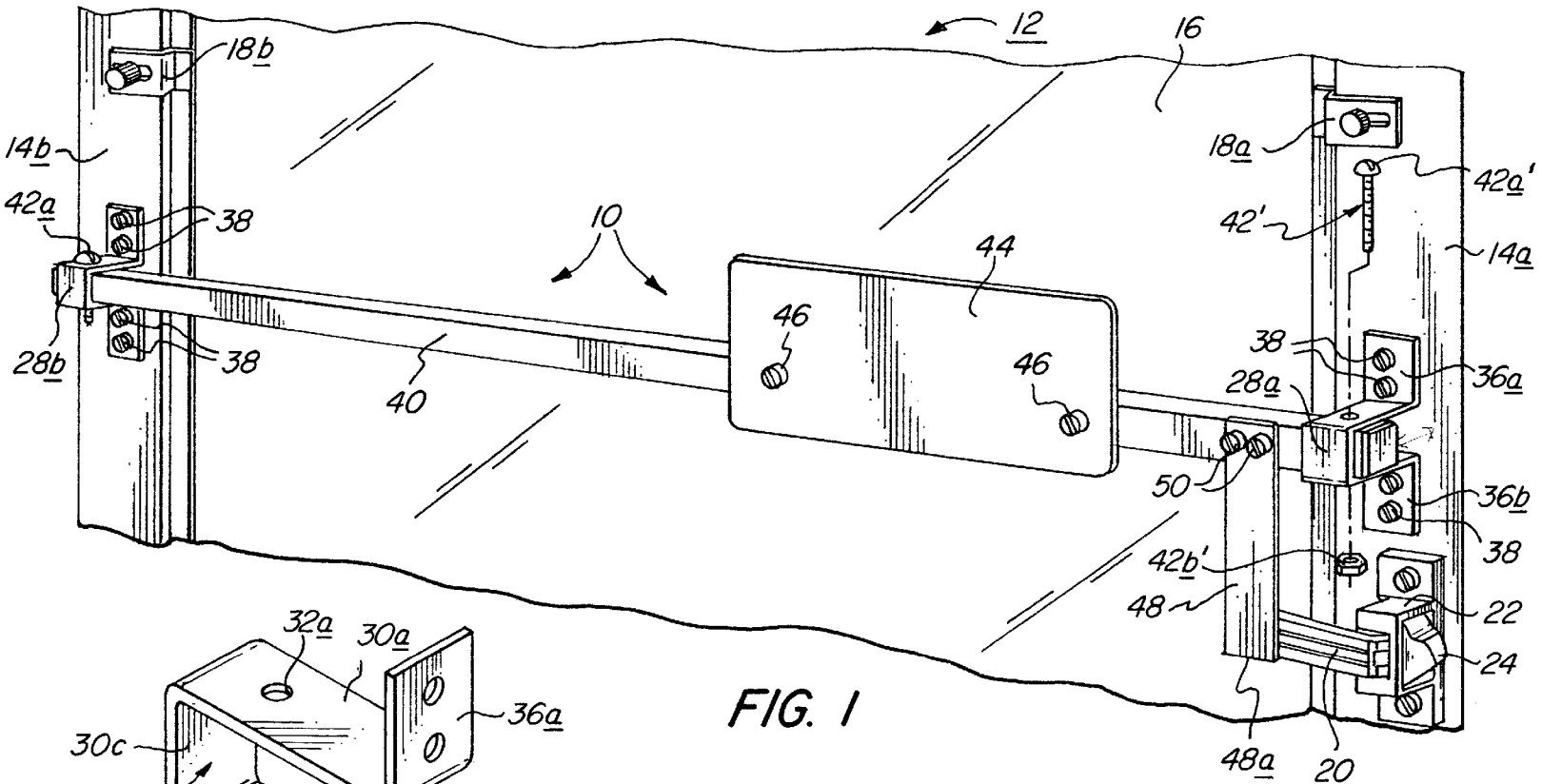
FIG. 1 is a perspective view of a door release device in accordance with one embodiment of the present invention mounted on the interior of a storm/screen door, portions of the storm/screen door being broken away.
Figure 3:
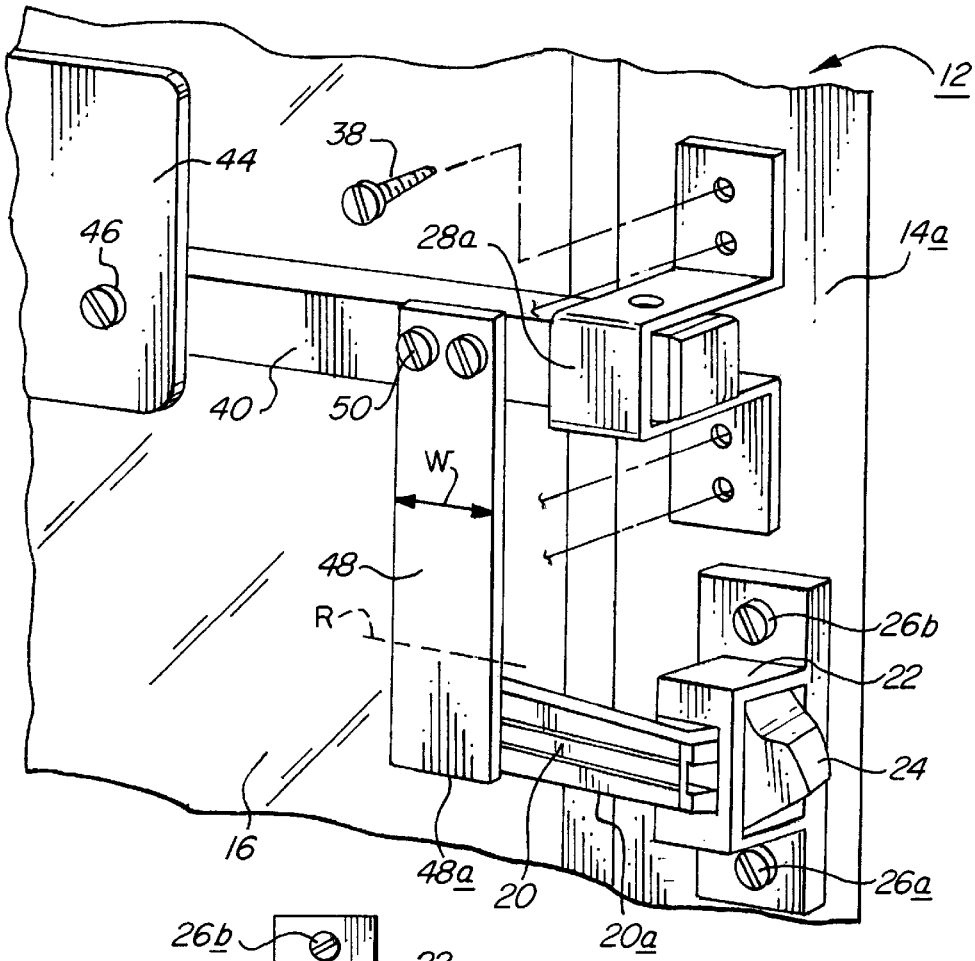
FIG. 3 is a perspective view, enlarged relative to FIG. 1, of the right-hand portion (as viewed in FIG. 1) of the door release device of FIG. 1, with mounting screws omitted or shown in exploded view.
Figure 3A:
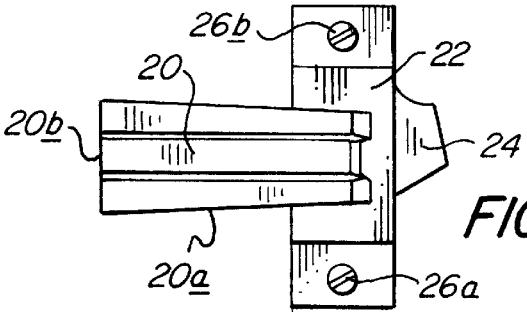
FIG. 3A is an elevation view of the door latch handle shown in FIG. 3.

Referring to FIG. 1, there is shown a door release device generally indicated at 10 mounted to a door 12 which is broken away so that only vertical risers 14*a*, 14*b* of the door frame and the glass pane 16 contained therein are visible. Door 12 may be a conventional storm/screen door in which, in the usual manner, glass pane 16 is held in place by a plurality of retainer clips 18*a*, 18*b* held in the door frame by finger-tightened screws. Two such typical retainer clips, 18*a* and 18*b*, are shown in FIG. 1. Door 12 is the known type of storm/screen door in which glass pane 16 may be replaced by a screen panel. As best seen in FIG. 3, door 12 has mounted on riser 14*a* thereof a conventional door handle 20 of the usual lever type. Door latch handle 20 is part of a conventional assembly comprising a casing 22 within which is contained a striker 24 and a conventional mechanism (not shown) which enables movement of striker 24 from the illustrated extended position to a withdrawn position within casing 22 by pushing door handle 20. Pushing door handle 20 towards door 12 so that it pivots relative to casing 22 will withdraw striker 24 within casing 22 so as to disengage striker 24 from the striker plate (not shown) mounted in the jamb (not shown) of the doorway in which door 12 is mounted. In the usual fashion, the striker plate has an opening formed therein about the periphery of a hole formed in the jamb of the doorway within which striker 24 is received when door handle 20 is in its rest position. The assembly of door handle 20, casing 22 and striker 24 is conventional and, in the usual manner, is mounted to (FIGS. 1 and 3A) riser 14*a* by a pair of screws 26*a*, 26*b* received within flanges (unnumbered) projecting from casing 22.

Figure 1A:
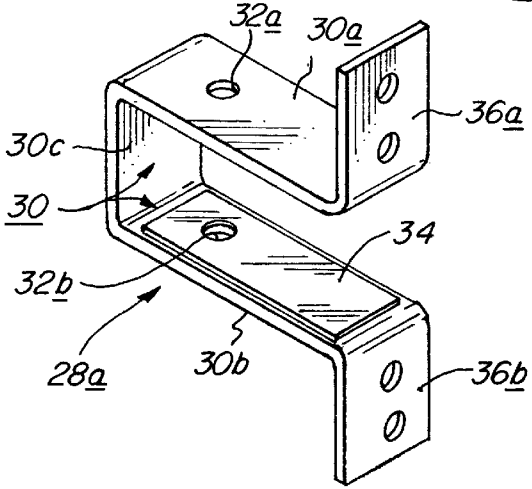
FIG. 1A is a perspective view of one of two identical mounting brackets forming part of the door release device of FIG. 1.

Referring again to FIG. 1, door release device 10 is mounted on door 12 by a pair of mounting brackets 28*a*, 28*b* which are identical to each other. FIG. 1A shows a perspective view of one of the brackets, bracket 28*a*, which has a bight 30 comprised of opposite legs 30*a*, 30*b* and a base 30*c*. Pivot pin holes 32*a*, 32*b* are formed in, respectively, legs 30*a* and 30*b* and are aligned with, i.e., are coaxial with, each other along a vertical axis. A low-friction pad 34, which may be made of a suitable polymer material having a very low coefficient of friction, i.e., material such as that sold under the trademark TEFLON by E.I. DuPont de Nemours and Company, is mounted on the interior of leg 30*b* of bight 30. Flanges 36*a*, 36*b* extend from, respectively, legs 30*a*, 30*b* and each has a pair of mounting holes (unnumbered) formed therein. Bracket 28*b* (FIG. 1) is identical to bracket 28*a*.

Bracket 28*a* is mounted onto vertical riser 14*a* and mounting bracket 28*b* is mounted on vertical riser 14*b*. Mounting brackets 28*a*, 28*b* are mounted by suitable screws 38 passing through flanges 36*a* and 36*b*.

A pivot bar 40 has one end thereof received in mounting bracket 28*a*, and its opposite end received within mounting bracket 28*b*. In the illustrated embodiment, one end of pivot bar 40 (the "fixed end") is received within mounting bracket 28*b* and is secured therein by a pivot pin 42, best seen in FIG. 2B. The head 42*a* (FIGS. 1 and 2B) of pivot pin 42 is received atop the leg 30*a* of bight 30 of mounting bracket 28*b*, and the opposite end thereof protrudes below the leg 30*b* of bight 30 and has a nut 42*b* (FIG. 2B) secured thereto. When door release device 10 is operated as described below, pivot bar 40 pivots about pivot pin 42 in a horizontal plane.

The opposite end of pivot bar 40, i.e., the end received within mounting bracket 28*a* (the "active end"), may, prior to installation of door release device 10 onto door 12, be secured within bracket 28*a* by an identical pivot pin 42' having a head 42*a*' which is shown in FIG. 1 along with nut 42*b*', as removed from bracket 28*a*. Pivot pin 42' is preferably removed from bracket 28*a* only after installation of door release device 10. Its removal leaves the active end of pivot bar 40 free to slide within bight 30 of bracket 28*a*, between the base 30*c* thereof and vertical riser 14*a*, as will be appreciated from FIGS. 2A-1 and 2A-2, which are further described below.

A push plate 44 is mounted on pivot bar 40 by a pair of screws 46. Push plate 44 is mounted off-center on pivot bar 40, closer to vertical riser 14*a* (and the active end of pivot bar 40) than to vertical riser 14*b* (and the fixed end of pivot bar 40). Between push plate 44 and mounting bracket 28*a*, an actuator 48 is mounted on pivot bar 40 by a pair of screws 50.

It should be noted that push plate 44 and actuator 48 may be mounted to pivot bar 40 by any suitable mechanical connectors. For example, the push plate and actuator may be mounted not only by screws, but they may be clipped on, mounted by bayonet-type connectors, spring-loaded detents, or the like.

The vertical edges of actuator 48 which contact door handle 20 are rounded to slide easily against door handle 20 without "hanging up" thereon. All four edges should be rounded in order to accommodate both left-hand and right-hand configurations of door release device 10, irrespective of how actuator 48 is oriented relative to pivot bar 40. The portions of the vertical edges of actuator 48 which would be rounded are essentially those between dash line R in FIG. 3 and bottom edge 48*a*, as that is the portion of actuator 48 which will contact door handle 20.

In order to install door release device 10 on door 12, it is only necessary to properly align actuator 48 with door handle 20, and then fasten mounting brackets 28*a* and 28*b* to the vertical risers, 14*a* and 14*b*, of door 12. Proper alignment of actuator 48 is attained by positioning the lower edge 20*a* of door latch handle 20 (FIG. 3A) in alignment with the bottom edge 48*a* (FIGS. 1 and 3) of actuator 48, and positioning distal edge 20*b* (FIG. 3A) of door latch handle 20 at about the halfway point of the width w (FIG. 3) of actuator 48. With actuator 48 thus properly aligned with door handle 20, it is only necessary for the installer to insure that pivot bar 40 is in a horizontal position when marking on vertical risers 14*a* and 14*b* the location of screws to be received through the holes (unnumbered) in flanges 36*a*, 36*b* of mounting brackets 28*a*, 28*b*. It should be noted that during installation, pivot pin 42' (FIG. 1) remains received within aligned holes 32*a*, 32*b* of mounting bracket 28*a* in order to retain pivot bar 40 in place with mounting bracket 28*a* (as well as mounting bracket 28*b*) fastened thereto. Once mounting brackets 28*a* and 28*b* are securely affixed to the respective vertical risers 14*a*, 14*b*, pivot pin 42' is removed from mounting bracket 28*a* and may be discarded. In order to assist the installer of door release device 10, a marking could be placed on actuator 48 to facilitate proper alignment of it with door handle 20, or the installer could simply be provided with instructions and/or an illustration to align actuator 48 with door handle 20 in the manner described above. Alternatively, or in addition, a positioning device such as a suitably designed clip could be temporarily affixed to the lower end of actuator 48 in order to act as a template to properly align the distal edge 20*b* of door latch handle 20 with actuator 48.

Figures 1, 2, 2A, 2B:
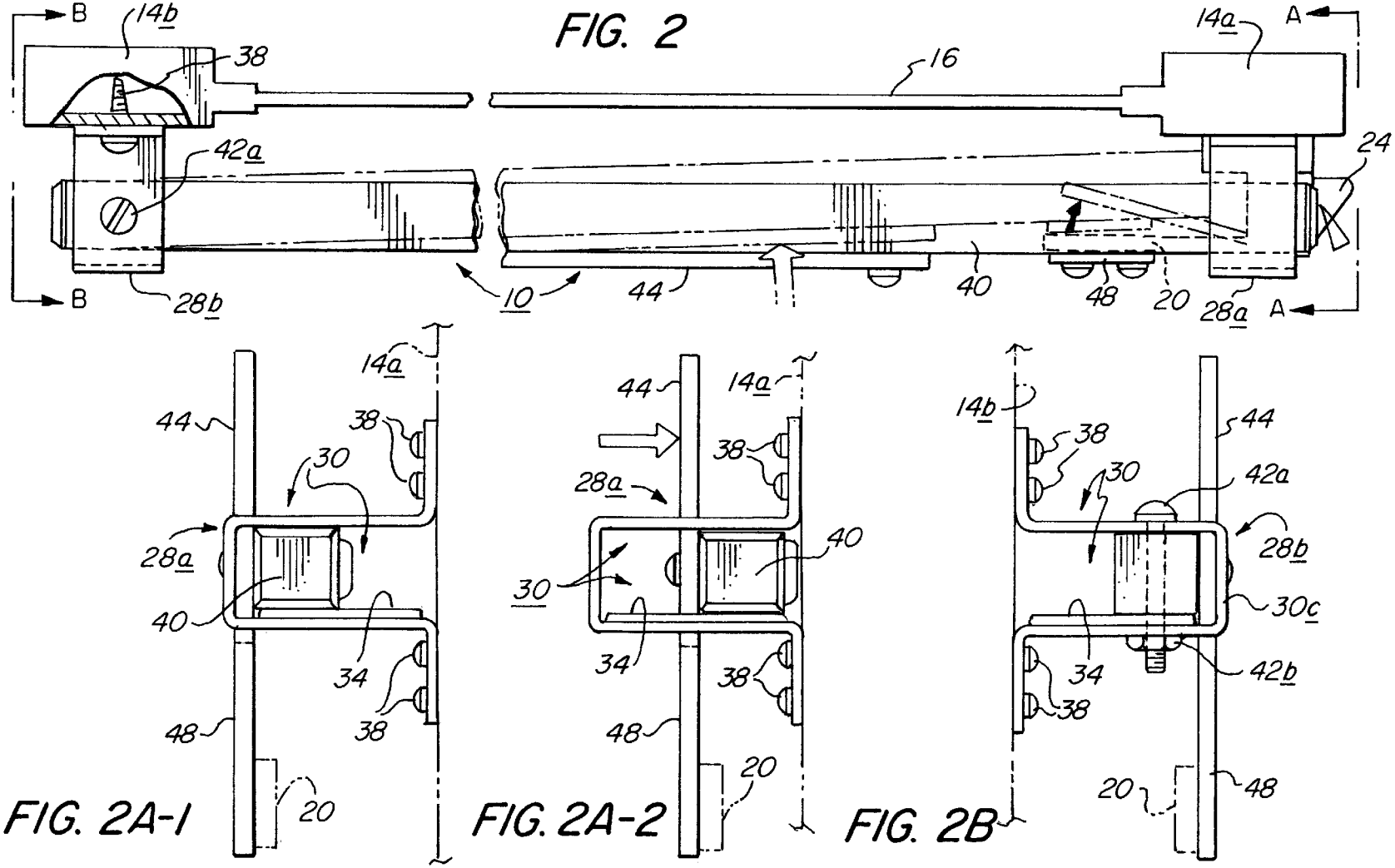

Operation of door release device 10 is illustrated in FIGS. 2, 2A-1 and 2A-2. When in the rest position, indicated by solid and dash lines in FIG. 2, pivot bar 40 is in contact with door handle 20 but is applying no force thereto, as shown in FIG. 2A-1. Accordingly, door handle 20 remains in its rest position with striker 24 protruding into the striker plate (not shown) mounted in the door jamb (not shown) within which door 12 is mounted. When it is desired to open door 12, the person wishing to do so merely pushes against push plate 44 or pivot bar 40, thereby pivoting pivot bar 40 about pivot pin 42 and moving actuator 48 and door handle 20 to the positions shown in FIG. 2A-2 and in phantom outline in FIG. 2. The unnumbered curved arrows in FIG. 2 show the direction of movement of, respectively, door handle 20 and striker 24. This results in the retraction of striker 24, thereby freeing the door 12 to be pushed open. When push plate 44 is released, thereby also releasing device 10, the conventional door return (not shown) will return door 12 to its closed position. (If there is no door return, door 12 is manually returned to its closed position.) The normal spring-loaded return action of the door latch handle 20 will return it to its rest position, with striker 24 re-inserted within the opening of the striker plate, and urge pivot bar 40 back to its neutral position.

The door release device may be configured for a left-hand- or right-hand-opening door, or reconfigured from a right-hand to a left-hand configuration, or vice versa, in a very simple fashion. This is accomplished by using a selected one of respective sets of mounting formations, e.g., holes, located at different axial positions along the pivot bar to accommodate the push plate and actuator at locations appropriate for a right-hand or left-hand configuration, depending on which set of mounting holes is used for the push plate and actuator. In one embodiment, this is accomplished by simply rotating the pivot bar about its longitudinal axis to position a selected set of mounting holes facing outwardly from the door to have the push plate and actuator mounted thereon. In a preferred version of this embodiment, the pivot bar has two sets of mounting holes, one formed on each of two opposite sides thereof, e.g., on a first face and a second, opposite face. If the pivot bar is, e.g., circular in cross section, the two respective sets of mounting holes may be located diametrically opposite each other, i.e., spaced 180 degrees from each other around the circumference of the pivot bar. In any case, by simply rotating the pivot bar 180 degrees about its axis, the selected one of the two sets of mounting holes (or other mounting formations) may be positioned facing outwardly away from the door and lying in a plane perpendicular to the door.

In a second embodiment, the pivot bar has only one set of mounting holes and the reconfiguration, for a left-hand- or right-hand-opening door, is attained by removing the push plate and actuator from the pivot bar, rotating them 180 degrees relative to the pivot bar and then re-affixing them. The entire assembly of pivot bar, push plate and actuator is then rotated 180 degrees end-over-end.

In all cases, the pivot pin is placed in the mounting bracket which is at the end of the pivot bar opposite to the end thereof which is adjacent to the door handle and close to the actuator.

Figure 4:
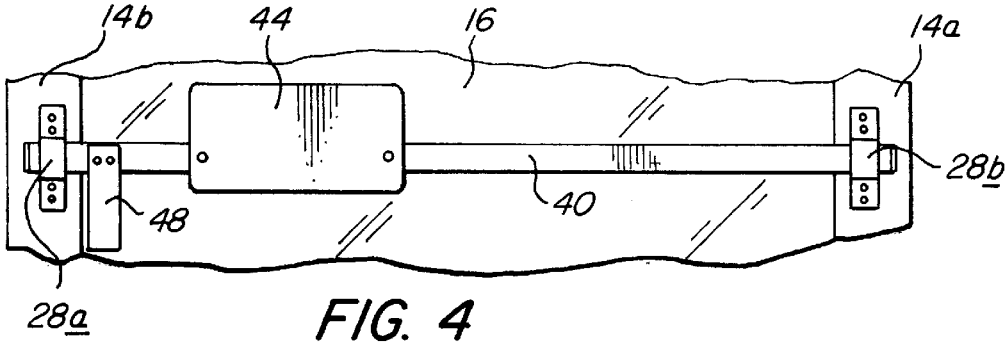
FIG. 4, reduced relative to FIG. 1, is a front elevation view of the door release device of FIG. 1 reconfigured for mounting upon a left-hand-opening door.

In the embodiment illustrated in FIG. 1, door release device 10 is shown as being mounted to operate a right-hand-opening door, as sensed from the side of the door containing the door latch handle 20. The door release device 10 may be reconfigured for installation on a left-hand-opening door simply by removing push plate 44 and actuator 48 from pivot bar 40, rotating them 180 degrees, and re-installing them into the same holes (not shown) in pivot bar 40 in which they were installed for the right-hand-opening configuration. This is readily accomplished by unscrewing machine screws 46 and 50 and then replacing them after rotating push plate 44 and actuator 48. The entire assembly is then rotated 180 degrees end-over-end so that mounting bracket 28*a* is aligned with vertical riser 14*b* and mounting bracket 28*b* is aligned with vertical riser 14*a*, as illustrated in FIG. 4.

Figure 5:
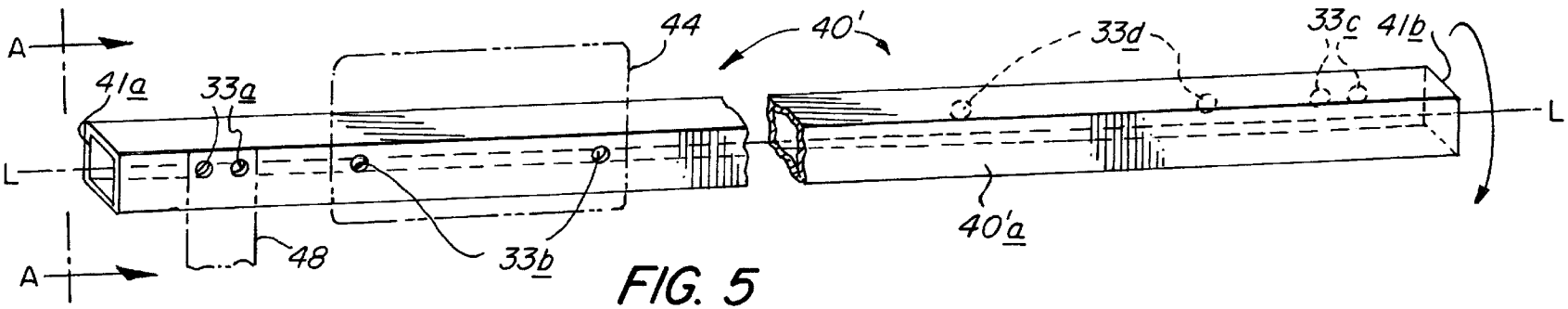
FIG. 5 is a perspective view of a pivot bar, with part broken away, in accordance with another embodiment of the present invention.
Figure 5A:
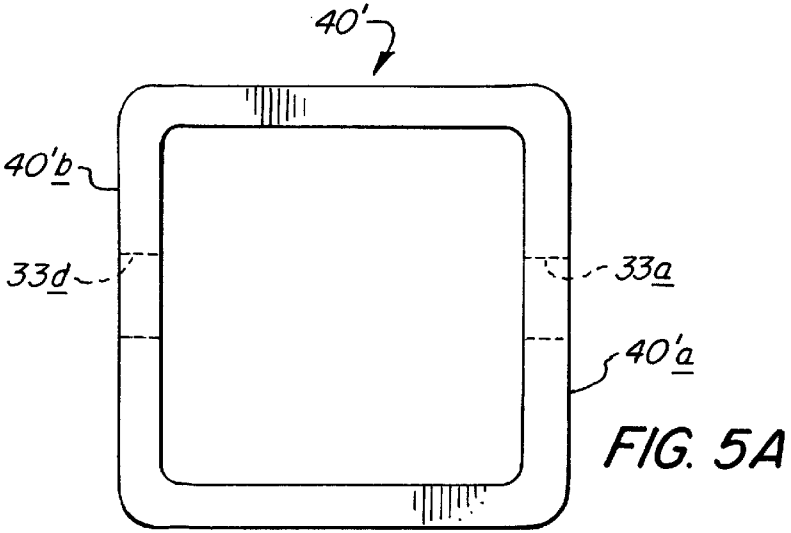
FIG. 5A is an end view in elevation of the pivot bar of FIG. 5, taken along line A—A of FIG. 5.

Referring to FIG. 5, another embodiment of a pivot bar is shown as pivot bar 40', partly broken away and with its longitudinal axis indicated by axis line L—L. The positions of actuator 48 and push plate 44 are shown in phantom lines, positioned for a left-hand-opening door configuration. FIG. 5A shows an enlarged (relative to FIG. 5) end view of pivot bar 40' taken along line A—A of FIG. 5. Pivot bar 40' has opposite longitudinal ends 41*a* and 41*b*, a first face 40'*a* and an opposite-facing, second face 40'*b*. A first set of actuator mounting holes 33*a* and push plate mounting holes 33*b* are located in first face 40'*a*, closer to end 41*a* than to end 41*b*. A second set of actuator mounting holes 33*c* and push plate mounting holes 33*d* (shown in dash lines) are located in second face 40'*b*, closer to end 41*b* than to end 41*a*. The actuator mounting holes 33*c* and push plate mounting holes 33*d* in second face 40'*b* are displaced along the longitudinal axis line L—L from the corresponding holes 33*a*, 33*b* in the first face 40'*a*. The actuator mounting holes 33*a* and push plate mounting holes 33*b* are located so as to position actuator 48 and push plate 44 in the location on pivot bar 40 which is appropriate for mounting the door release device on a left-hand-opening door. In such case, first face 40'*a* will face away from the door and second face 40'*b* will face towards the door. When the door release device is to be mounted on a right-hand-opening door, actuator 48 is removed from mounting holes 33*a* and push plate 44 is removed from mounting holes 33*b*. Pivot bar 40' is then rotated 180 degrees about its longitudinal axis L—L, as suggested by the unnumbered curved arrow in FIG. 5, so that second face 40'*b* faces away from the door and first face 40'*a* faces towards the door. In this orientation, actuator mounting holes 33*c* and push plate mounting holes 33*d* are positioned to attach actuator 48 and push plate 44 in locations appropriate for a right-hand-opening door. Actuator 48 and push plate 44 may be removably attached to pivot bar 40' by fasteners (e.g., machine screws) inserted into the respective mounting holes. In each case, the actuator mounting holes not in use face towards the door and therefore do not mar the esthetic appearance of the door release device.

As indicated above, plate 44 and actuator 48 may be attached to pivot bar 40 by any suitable mechanical connectors or fasteners. Reference in the claims to "mounting formations" of the pivot bar means and includes holes as illustrated in the drawings for receiving screws to attach push plate 44 and actuator 48 to pivot bar 40, or they may comprise recesses formed in pivot bar 40 to receive spring-loaded detents or spring clips or the like, or they may comprise openings dimensioned and configured to receive and retain bayonet-type connectors. It should also be noted that differently configured actuators 48 may be provided in an assembly kit to accommodate different configurations of door latch handle 20. Thus, actuator 48 may be configured differently from that illustrated to operate other types of door handles. For example, the type of door handle which is operated by pivoting it downwardly may be engaged on its top side by an actuator having an angled contact lip which, as pivot bar 40 is pushed inwardly, forces the handle downwardly to its door-opening position.

It will be appreciated that push plate 44 or pivot bar 40 may be pushed not only by hand, but by a user's elbow, shoulder, torso, etc., thereby facilitating opening of the door when the user's hands are full, as by carrying parcels, or if the user is handicapped in the use of hands or arms. It will be further appreciated that the device is simple, easy to install, and may be made at relatively low cost. While any suitable materials may be utilized, aluminum is preferred. The aluminum may be anodized or otherwise treated to enhance its aesthetic appeal, and the edges of push plate 44 and actuator 48 may be rounded to provide a smooth contour.

It will further be appreciated that upon a reading and understanding of the foregoing, numerous variations to the illustrated embodiment will become apparent, which variations are nonetheless within the spirit and scope of the present invention. For example, the top and bottom edges of push plate 44 may be turned back in a 90- or 180-degree flange to provide a rounded top and bottom to push plate 44.

What is claimed is:

1. A push-action door release device comprising a pivot bar having first and second opposite ends, the first end of the pivot bar being received within a first mounting bracket and being pivotably connectable thereto by a first removable pivot pin, the second end of the pivot bar being received within a second mounting bracket and being pivotably connectable thereto by a second removable pivot pin, the mounting brackets being dimensioned and configured to be secured to a door having a latch handle to position the pivot bar substantially parallel to the door with one end of the pivot bar disposed adjacent to the latch handle, whereby (i) either end of the pivot bar, when unpinned from its associated mounting bracket will constitute that end as the active end of the pivot bar and render it free to travel along an operational travel path of the active end between a neutral position and a handle release position, the travel path being confined within the mounting bracket within which the active end is received and (ii) the other end of the pivot bar, when connected by its associated pivot pin to its associated mounting bracket will constitute that end as the fixed end of the pivot bar, whereby the door release device is selectively utilizable for either a left-hand or right-hand opening door;

the release device being dimensioned and configured to engage and operate the latch handle of such door when the active end of the pivot bar is caused to travel along its operational travel path to the handle release position by pivoting the fixed end of the pivot bar about its associated pivot pin.

2. The door release device of claim 1, wherein the pivot bar has an actuator extending transversely therefrom the actuator being dimensioned and configured to engage and operate the latch handle upon arrival of the active end of the pivot bar at its handle release position.

3. The door release device of claim 1 or claim 2 having a push plate attached to the pivot bar and extending transversely thereof.

4. The door release device of claim 3 wherein at least the actuator is selectively mountable adjacent to either end of the pivot bar.

5. The door release device of claim 2 wherein the pivot bar further has a push plate extending transversely therefrom and both the actuator and the push plate are selectively mountable in at least two different positions axially along the pivot bar.

6. The door release device of claim 5 wherein the pivot bar has at least two sets of mounting formations for each of the push plate and actuator, the two sets of mounting formations being located on opposite transverse sides of the pivot bar, one set of mounting formations being axially positioned along the pivot bar whereby to locate the push plate and actuator to accommodate a right-hand-opening door, and the other set of mounting formations being axially positioned along the pivot bar whereby to locate the push plate and actuator to accommodate a left-hand-opening door.

7. The door release device of claim 6 wherein the mounting formations are holes dimensioned and configured to receive removable fasteners to removably secure the push plate and actuator to the pivot bar.

8. A method for securing to a door equipped with a latch handle a door release device comprised of a pivot bar having first and second opposite ends, the first end of the pivot bar being connected to a first mounting bracket by a first removable pivot pin, and the second end of the pivot bar being connected to a second mounting bracket by a second removable pivot pin, the method comprising the steps of:

(a) securing the device to a door having a latch handle to position the pivot bar substantially parallel to the door with one end of the pivot bar disposed adjacent to the latch handle to constitute that end as the active end of the pivot bar, and the other end as the fixed end of the pivot bar; and (b) removing the pivot pin from the mounting bracket at the active end of the pivot bar, thereby freeing the active end to travel along an operational travel path within its associated mounting bracket between a neutral position and a latch handle release position, when the pivot bar is pivoted about its fixed end.

9. The method of claim 8 wherein the pivot bar further comprises at least two sets of actuator mounting formations, the respective sets of mounting formations being located adjacent respective opposite ends of the pivot bar, the method further comprising mounting the actuator on the set of actuator mounting formations adjacent the active end of the pivot bar.

10. The method of claim 9 wherein at least two of the respective sets of actuator mounting formations are located on diametrically opposite sides of the pivot bar and the method further comprises positioning the pivot bar relative to such door so that the set of mounting formations on which the actuator is to be mounted faces outwardly away from the door.

11. A push-action door release device comprising a pivot bar having first and second opposite ends and an actuator extending transversely therefrom, the first end of the pivot bar being received within a first mounting bracket and being pivotably connected thereto by a first removable pivot pin, the second end of the pivot bar being received within a second mounting bracket and being pivotably connected thereto by a second removable pivot pin, the mounting brackets being dimensioned and configured (i) to be secured to a door having a latch handle to position the pivot bar substantially parallel to the door with one end of the pivot bar disposed adjacent to the latch handle and unpinned from its associated mounting bracket to constitute that end as the active end of the pivot bar, and the other end of the pivot bar being connected by its associated pivot pin to its associated mounting bracket to constitute that end as the fixed end of the pivot bar, (ii) to thereby define an operational travel path of the active end of the pivot bar within its associated mounting bracket between a neutral position and a handle release position, the travel path being confined within the mounting bracket within which the active end is received;

the actuator being selectively mountable in at least two different positions axially along the pivot bar and being dimensioned and configured to engage and operate the latch handle of such door when the actuator is affixed to the pivot bar and the active end of the pivot bar is caused to travel along its operational travel path to the handle release position by pivoting the fixed end of the pivot bar about its associated pivot pin.

12. The door release device of claim 11 wherein the actuator is selectively mountable adjacent to either end of the pivot bar.

13. The door release device of claim 11 further having a push plate attached to the pivot bar and extending transversely thereof.

14. The door release device of claim 13 wherein both the actuator and the push plate are each selectively mountable in at least two different positions axially along the pivot bar.

15. A push-action door release device comprising a pivot bar having first and second opposite ends, the first end of the pivot bar being pivotably connectable to a first mounting bracket by a first removable pivot pin, the second end of the pivot bar being pivotably connectable to a second mounting bracket by a second removable pivot pin, the mounting brackets being dimensioned and configured (i) to receive therewithin the respective end of the pivot bar associated therewith and, (ii) to be secured to a door having a latch handle to position the pivot bar substantially parallel to the door with one end of the pivot bar disposed adjacent to the latch handle, the opposite ends of the pivot bar and their respective mounting brackets being similarly dimensioned and configured whereby (iii) either end of the pivot bar may be positioned adjacent to the latch handle and, when unpinned from its associated mounting bracket, freed to serve as the active end of the pivot bar, and (iv) the other end of the pivot bar, when pinned to its associated mounting bracket, is connected thereto to serve as the fixed end of the pivot bar;

the release device being dimensioned and configured to engage and operate the latch handle of such door when the pivot bar is pivoted about its fixed end to move the active end of the pivot bar along a travel path confined within its associated mounting bracket and sufficiently to operate the latch handle.

* * * * *